US010043370B2

(12) United States Patent
Le et al.

(10) Patent No.: US 10,043,370 B2
(45) Date of Patent: Aug. 7, 2018

(54) FLOATING TOUCH FALL ALERT BATH MAT SYSTEM

(71) Applicant: GUANGDONG APPSCOMM CO., LTD., Guangzhou, Guangdong (CN)

(72) Inventors: Liuping Le, Guangdong (CN); Shangfeng Xie, Guangdong (CN); Daifu Zheng, Guangdong (CN)

(73) Assignee: GUANGDONG APPSCOMM CO., LTD., Guangzhou (CN)

( * ) Notice: Subject to any disclaimer, the term of this patent is extended or adjusted under 35 U.S.C. 154(b) by 0 days.

(21) Appl. No.: 15/541,486

(22) PCT Filed: Jun. 3, 2016

(86) PCT No.: PCT/CN2016/084713

§ 371 (c)(1),
(2) Date: Jul. 5, 2017

(87) PCT Pub. No.: WO2016/202181

PCT Pub. Date: Dec. 22, 2016

(65) Prior Publication Data

US 2018/0025608 A1 Jan. 25, 2018

(30) Foreign Application Priority Data

Jun. 17, 2015 (CN) ..... 2015 1 0338666

(51) Int. Cl.
*G08B 21/04* (2006.01)

(52) U.S. Cl.
CPC ..... *G08B 21/0461* (2013.01); *G08B 21/043* (2013.01)

(58) Field of Classification Search
CPC .. G08B 21/043; G08B 21/0461; A61B 5/103; A61B 5/1117; A61B 5/681;
(Continued)

(56) References Cited

U.S. PATENT DOCUMENTS

2007/0085690 A1* 4/2007 Tran ..... A61B 5/103 340/573.1
2007/0132578 A1* 6/2007 Powell ..... G08B 21/023 340/539.26

(Continued)

*Primary Examiner* — Orlando Bousono

(57) ABSTRACT

The present invention discloses a float touching fall alert bath mat system, wherein a power management module is installed in a body, the power management module is electrically connected to a single chip microcomputer (SCM) and a sensor, a front end of the sensor is equipped with floating touch sensor chips in sheet structure, the floating touch sensor chips are configured around the body, and the power management module is electrically connected to a wireless communication module; the SCM conducts calculation according to the real-time position information to obtain a size and a shape of a contact area between a human body and a bath mat, a reaction time of contact change and a movement direction of the human body; the system can accurately detect whether an actual fall has occurred. The present invention has the advantages of small size and low power consumption. With a big monitoring area, it conducts highly accurate monitoring covering the size and the shape of the contact area, the reaction time of contact change and the movement direction of human body. It can accurately judge whether the user has fell and his falling direction, and can predict a possible injured position to provide assistance for rescue.

7 Claims, 3 Drawing Sheets

(58) Field of Classification Search
CPC ..... A61B 5/0022; A61B 5/03; A61B 5/6811; G06F 19/3418; G06F 19/3481
See application file for complete search history.

(56) References Cited

U.S. PATENT DOCUMENTS

| | | | | |
|---|---|---|---|---|
| 2008/0268731 | A1* | 10/2008 | Lahyani | A41D 7/003 441/89 |
| 2008/0319282 | A1* | 12/2008 | Tran | A61B 5/103 600/301 |
| 2013/0135097 | A1* | 5/2013 | Doezema | G08B 21/0446 340/539.13 |
| 2014/0125678 | A1* | 5/2014 | Wang | A63F 13/005 345/473 |
| 2014/0143064 | A1* | 5/2014 | Tran | A61B 5/0022 705/14.66 |
| 2014/0375434 | A1* | 12/2014 | Puljan | F21V 33/004 340/12.5 |
| 2016/0287166 | A1* | 10/2016 | Tran | H04B 1/3827 |

* cited by examiner

FLOATING TOUCH FALL ALERT BATH MAT SYSTEM

TECHNICAL FIELD

The present invention relates to the field of safety protection, and more particularly, to a floating touch fall alert bath mat system.

BACKGROUND

In daily life, accidents happen in a bathroom frequently, such as coal gas leakage, electric shock problem, tumble problem, etc. Meanwhile, with the development of human society, most countries in the world are facing an increasingly serious aging problem is various degree. The injury of the elderly caused by fall in the bathroom is very common. Thus solving the issue of how to send alarm automatically after someone falls in a bathroom for timely rescue and avoid a second injury to the injured people caused by forced self-movement due to lack of attending has become much looked forward to.

With the continuous development of communication and microsensor technologies and ever-evolving information society, it becomes possible to develop a convenient and reliable fall alert device. People hope to have a device that can send alarms automatically in case of any unexpected fall causing injury, so that the injured people can receive treatment in time.

With respect to the situation that people can fall easily in the wet environment of a bathroom, a device which can detect the fall of the human body accurately and send alarms automatically, and does not require reconstruction of the bathroom, becomes necessary.

At present, common technologies used to detect the bathroom fall include: (A) an analysis of an audio signal, wherein a fall event is detected through analysis of the vibration frequency caused by an impact, which has the disadvantages of complicated installation, easy misjudgment and poor universality; (B) an analysis of video images, wherein a camera is used to monitor the movement of a target user, which can easily expose the privacy of the user; and (C) an analysis of data of pressure change after the fall, wherein the fall can only be monitored when it occurs within the coverage of a pressure sensor, but the wet environment in the bathroom makes it difficult to place the sensor.

SUMMARY

In view of the above problems, the present invention is intended to provide a floating touch fall alert bath mat with low power consumption, keen reaction, high accuracy, big coverage, and simple installation.

In order to achieve the technical objects above, the solution of the present invention is as follows. A float touching fall, alert bath mat system includes a body and a power management module, wherein the power management module is installed within the body, the power management module is electrically connected to a single chip microcomputer (SCM) and a sensor, a front end of the sensor is equipped with floating touch sensor chips in sheet structure, the floating touch sensor chips are configured around the body, and the power management module is electrically connected to a wireless communication module;

through the floating touch sensor chips configured around the body, the sensor detects the change of human body current in real time, and proceeds to judge a position of the human body in contact with a bath mat; then the sensor transfers the position information to the SCM;

the SCM conducts calculation based on the real-time position information to obtain a size and a shape of a contact area between the human body and the bath mat, the reaction time of contact change, and a movement direction of the human body; and with the data above being analyzed, when the position is abnormal, the system further analyzes whether the contact area at this moment is larger than a threshold value (previous contact area or normal standing area). If the contact area is larger than the threshold value, the analysis will be continued; when an actual fall is identified as the reaction time exceeds the threshold value (quick fall), plus an analysis of whether the user falls forward or backward according to his moving direction and change of contact position is conducted, the SCM sends a signal to the power management module to activate the wireless communication module, which sends the information to a caregiver or a service center. Meanwhile, the sensor continues monitoring the state of the user to judge whether the fall continues and whether the user is conscious.

Preferably, the power management module is electrically connected to an independent power supply, and the independent power supply is a button battery.

Preferably, the SCM is connected to a microphone and a loud speaker, and the caregiver may talk with the user through the microphone and the loud speaker under the assistance of a wireless communication module to judge a fall condition.

Preferably, the sensor is in a continued working state and the SCM a dormant state. When the human body is in contact with the float touch sensors, the SCM will be activated to a working state and perform real-time data analysis.

Preferably, the wireless communication module is a Bluetooth 4.0 module, and the Bluetooth 4.0 module is wirelessly connected to other devices with Bluetooth module.

Preferably, by analyzing the shape change of the contact area and reaction time of the change when a user falls, the SCM locates an impacted part of the user during the fall, and proceeds to predict his possible injured position to provide rescue data for the service center.

Preferably, the float touch sensor is in regular hexagon structure.

The present invention has beneficial effects that it provides an accurate and effective solution to deal with the problem of bathroom fall. Installed as part of the bath mat, the system does not require additional electrical equipment or reconstruction of the bathroom environment. It is safe and reliable as it is waterproof, and operates under weak current with above 95% accuracy. Meanwhile, the system is of small size and low power consumption. With a big monitoring area, it conducts highly accurate real-time detection covering the size and the shape of the contact area, the reaction time of contact change and the movement direction of the human body. It can accurately detect whether the user actually falls and his falling direction, and meanwhile predicts the possible injured position to assist rescue. The use of button battery is convenient as it involves simple installation and has long service time; the Bluetooth 4.0 adopted as a communication module has low power consumption, low cost and high stability; and the use of microphone and the loud speaker for real-time interaction can reduce privacy disclosure and realize in-time communication of the falling condition.

DETAILED DESCRIPTION

The present invention is further described in details hereunder with reference to the drawings and embodiments.

Figure 1:
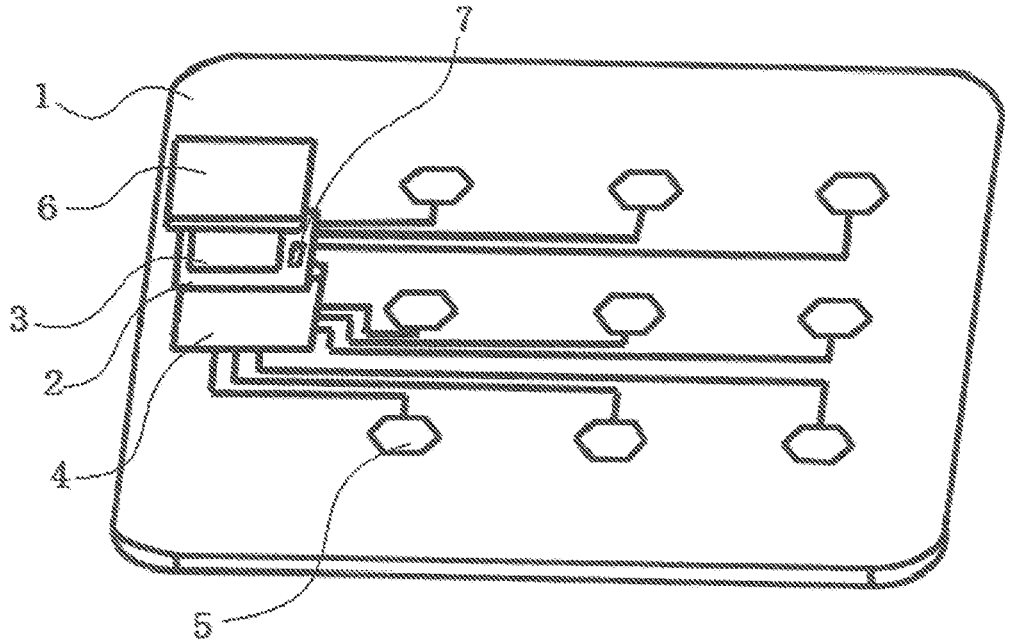
FIG. 1 is a structure drawing of the present invention.
Figure 2:
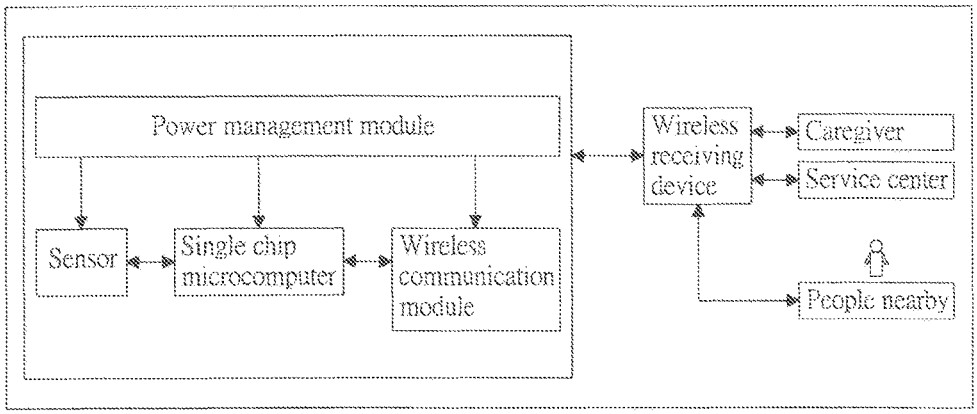
FIG. 2 is a structure diagram of the present invention.
Figure 3:
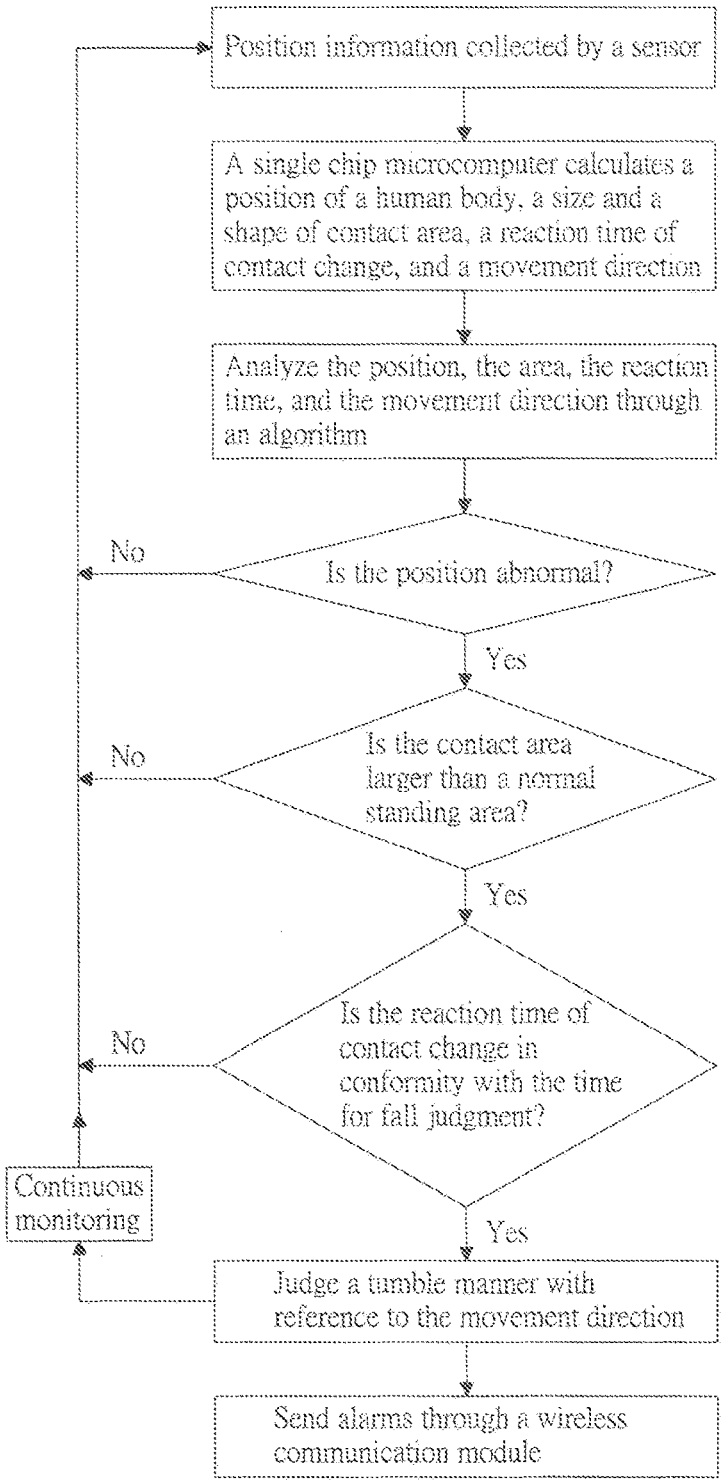
FIG. 3 is a working flow chart of the present invention.

As shown in FIGS. 1, 2, and 3, the embodiment according to the present invention is a float touching fall alert bath mat system comprising a body 1 and a power management module 2, wherein the power management module 2 is installed in the body 1, the outside of the power management module 2 is coated with a sealed chamber 6 for waterproofing, the power management module 2 is electrically connected to a single chip microcomputer (SCM) 3 and a sensor 4, a front end of the sensor 4 is equipped with floating touch sense chips 5 in sheet structure, the floating touch sensor chips 5 are configured around the body 1, and the power management module 2 is electrically connected to a wireless communication module 7;

through the floating touch sensor chips 5 configured around the body 1, the sensor 4 conducts a real-time detection of a change of human body current, and proceeds to judge a position of a human body in contact with a bath mat; then the sensor transfers the position information to the SCM;

the SCM 3 calculates based on the real-time position information to obtain a size and a shape of a contact area between the human body and the bath mat, reaction of the contact change, and a movement direction of the human body; and with the data above being analyzed, when the position is abnormal, the system further analyzes whether the contact area at this moment is larger than a threshold value (previous contact area or normal standing area). If the contact area is larger than the threshold value, then the analysis will be continued; when an actual fall is identified as the reaction time exceeds the threshold value (quick fall), plus an analysis of whether the user falls forward or backward according to his moving direction and change of contact position, the SCM 3 sends a signal to the power management module 2 to activate the wireless communication module 7, which sends the information to people nearby, a caregiver, or a service center. Meanwhile the sensor 4 continues monitoring a state of the user, so as to judge whether the falling continues and whether the user is conscious.

In order to facilitate the installation, the power management module 2 is electrically connected to an independent power supply, and the independent power supply is a button battery. The button battery is of simple installation and small size, fitting the present invention of also small size and low power consumption. A single button battery has enduring working time and generally requires replacement only once about half a year.

In order to facilitate the communication on safety between the caregiver and the user, the SCM 3 is connected to a microphone and a loud speaker. The caregiver may talk with the user through the microphone and the loud speaker under the assistance of a wireless communication module to judge a falling condition. Since the bathroom is a private place, the use of a camera can easily disclose the users' privacy, while the use of microphone and loudspeaker guarantees safe emergency communication and provides instant feedback of the user's condition after the fall. The microphone and the loudspeaker can be installed either inside the bath mat, or out of the mat with wireless connection realized via Bluetooth facilities.

In order to increase the standby time of the equipment, the sensor is in a continued working state, and the SCM in a dormant state. It is only when the human body is in contact with the floating touch sensor chips will the SCM be activated and switched to the working mode to perform real-time data analysis. As the bathroom is unused in most of the time, keeping the SCM in dormant state can save electricity and extend the standby time of the device.

In order to facilitate the communication, the wireless communication module is a Bluetooth 4.0 module, and it is wirelessly connected to other devices with Bluetooth modules. With low power consumption and high stability, the Bluetooth 4.0 can work continuously for a long time and effectively reduce the power consumption. Meanwhile, today facilities such as mobile phones and tablet personal computers all have the Bluetooth and wireless communication modules. Transmission through these modules can effectively reduce the power consumption and cost of the device.

In order to improve the rescue efficiency, the SCM can locate an impacted part of the user during the fall by analyzing a shape change of the contact area and the reaction time of contact change, so as to predict a possible injured position and provide rescue data for the service center. With the injured position being predicted, medical workers can have more time to prepare a rescue scheme and professional equipment, and thus can implement rescue at once when they arrive at the site of the fall.

In order to improve sensitivity, the floating touch sensor chip is in regular hexagon structure. The sensor chips in regular hexagon structure enable more effective placement for the purpose of sensing, and improve the sensitivity by reducing overlap in the sensing area.

The sensor used for detecting in the present system is DS_TI0240, and its floating touch technology is different from the traditional capacitive touch sensing technology. The traditional technology requires a skin contact between the human body and the sensing material to identify the touch, while the floating touch technology of the present sensor detects human body induction even if the sensing material is not in direct contact with the human body. It allows a gap of air or non-alloyed material (plastic, wooden material, fiber, ceramic, etc.) between them with a distance of 30 cm or above for sensing. While each floating touch sensor chip covers a floating distance of 30 cm or above, a single sensor chip covers even higher and thus can greatly reduce the entire size of the bath mat. Meanwhile, the detection effect is not influenced even if the user to be detected wears clothes, stocks or shoes. Generally, the floating touch sensor chip can detect human body information across the air by using copper sheet or graphite as its electric conductor. Therefore, the bath mat can be of various forms and is almost free from the limit of induction materials.

Through the floating touch sensor chips, the sensor detects the change of the human body current via capacitive sensing, and proceeds to judge the position of the human body in contact with the bath mat. Meanwhile, obtaining the position information from the sensor, the SCM operates an algorithm to calculate the contact area between the human body and the bath mat, the reaction time of contact change and the movement direction of the human body. When the human body falls on the bath mat, the SCM uses the algorithm to calculate based on the data from the sensor, working out that the contact area between the human body and the bath mat far exceeds the normal standing area or the contact area before falling, and the reaction time of contact change much shorter than that of normal contact. Meanwhile, it uses the algorithm to filter the false triggered data and thus proceeds to accurately judge whether an actual fall has occurred.

Once an actual fall is detected, the system enters an alarming state. The power management module immediately activates the wireless communication module to send information to the terminals of people nearby, the service center, or the caregiver. The receiving device is those with Bluetooth and wireless communication function, such as: a mobile phone, a Bluetooth bracelet, a computer, a tablet personal computer, etc. Meanwhile, the data of the contact area change during the falling will also be transmitted to the medical workers.

Meanwhile, the system continues with the monitoring: if the contact area returns to normal after a short while, the user may terminate the alarming state manually; if the contact area remains large with no change, it indicates a severe falling status, and the microphone and the loudspeaker are started up for real-time interaction; if the contact area remains large but with a slight change, it indicates that the user may be conscious, and the microphone and the loudspeaker are started up for real-time interaction. Through continuous monitoring and real-time interaction, the system ensures constant care for the user after his falling and provides the best rescue scheme.

The foregoing is merely preferred embodiments of the invention, but is of intended to limit the invention; and any fine modification, equivalent replacement and improvement made to the above embodiments according to the technical substance of the invention shall all fall within the protection scope of the technical solutions of the invention.

We claim:

1. A floating touch fall alert bath mat system comprising a body and a power management module, wherein the power management module is installed in the body, the power management module is electrically connected to a single chip microcomputer (SCM) and a sensor, a front end of the sensor is equipped with floating touch sensor chips in sheet structure, the floating touch sensor chips are configured around the body, and the power management module is electrically connected to a wireless communication module;

through the floating touch sensor chips configured around the body, the sensor detects a change of a human body current in real time to determine a position contacted by the human body in a bath mat, and the sensor transmits the position information to the SCM;

the SCM conducts calculation based on the real-time position information to obtain a size and a shape of a contact area between the human body and the bath mat, reaction time of contact change and movement direction of the human body; and with the data above being analyzed, when the position is changed, the system analyzes whether the contact area is larger than a threshold value (previous contact area or normal standing area); if the contact area is larger than the threshold value, then the analysis will be continued; when an actual fall is identified as the position changing time exceeds the threshold value (quick fall), plus an analysis of whether the human body falls forward or backward according to his moving direction and change of contact position, the SCM sends a signal to the power management module to activate the wireless communication module, which sends the fall information to a caregiver or a service center; meanwhile, the sensor continues monitoring the state of the human body to judge whether the fall continues and whether the human body is conscious.

2. The float touching fall alert bath mat system according to claim 1, wherein the power management module is connected to an independent power supply, and the independent power supply is a button battery.

3. The float touching fall alert bath mat system according to claim 1, wherein the SCM is connected to a microphone and a loudspeaker, and the caregiver may talk with the user through the microphone and the loudspeaker under the assistance of the wireless communication module to determine a falling condition.

4. The float touching fall alert bath mat system according to claim 1, wherein the sensor i.s in a continued working state, and the SCM in a dormant state; it is only when the human body is in contact with the floating touch sensor chips will the SCM be switched into a working mode to perform real-time data analysis.

5. The float touching fall alert bath mat system according to claim 1, wherein the wireless communication module is a Bluetooth-based communication module.

6. The float touching fall alert bath mat system according to claim 1, wherein by analyzing the shape change of the contact area and the reaction time of the change when the human body falls, the SCM located an impacted part of the human body, and proceeds to predict the human body's possible injured position to provide rescue data for the service center.

7. The float touching fall alert bath mat system according to claim 1, wherein the floating touch sensor chips are in regular hexagonal structures.

* * * * *